US006503138B2

(12) United States Patent
Spoehr et al.

(10) Patent No.: US 6,503,138 B2
(45) Date of Patent: Jan. 7, 2003

(54) METHOD AND APPARATUS FOR BAG STOPPING IN A SMALL COIN SORTER

(75) Inventors: Myron W. Spoehr, Lake Mills, WI (US); John A. Kressin, Watertown, WI (US); John Grajewski, Palmyra, WI (US); Cory A. Kohls, Oconomowoc, WI (US)

(73) Assignee: De La Rue Cash Systems, Inc., Lisle, IL (US)

( * ) Notice: Subject to any disclaimer, the term of this patent is extended or adjusted under 35 U.S.C. 154(b) by 117 days.

(21) Appl. No.: 09/799,176

(22) Filed: Mar. 5, 2001

(65) Prior Publication Data

US 2002/0123303 A1 Sep. 5, 2002

(51) Int. Cl.[7] ..... G07D 3/00
(52) U.S. Cl. ..... 453/10; 453/12; 453/32
(58) Field of Search ..... 453/3–6, 9, 10, 453/12, 13, 16, 17, 32, 57, 58; 188/158, 160, 162

(56) References Cited

U.S. PATENT DOCUMENTS

| | | | | |
|---|---|---|---|---|
| 2,835,260 A | | 5/1958 | Buchholz | 133/8 |
| 3,998,237 A | * | 12/1976 | Kressin et al. | 221/10 |
| 4,921,463 A | * | 5/1990 | Primdahl et al. | 188/160 |
| 5,011,455 A | | 4/1991 | Rasmussen | 453/10 |
| 5,123,873 A | | 6/1992 | Rasmussen | 453/10 |
| 5,141,443 A | | 8/1992 | Rasmussen et al. | 453/10 |
| 5,277,651 A | | 1/1994 | Rasmussen et al. | 453/10 |
| 5,299,977 A | | 4/1994 | Mazur et al. | 453/10 |
| RE34,934 E | | 5/1995 | Raterman et al. | 453/10 |
| 5,429,550 A | | 7/1995 | Mazur et al. | 453/10 |
| 5,453,047 A | | 9/1995 | Mazur et al. | 453/10 |
| 5,474,497 A | | 12/1995 | Jones et al. | 453/17 |
| 5,480,348 A | | 1/1996 | Mazur et al. | 453/10 |
| 5,514,034 A | | 5/1996 | Jones et al. | 453/10 |
| 5,525,104 A | | 6/1996 | Adams et al. | 453/10 |
| 5,564,978 A | | 10/1996 | Jones et al. | 453/17 |
| 5,992,602 A | | 11/1999 | Zwieg et al. | 194/317 |

* cited by examiner

*Primary Examiner*—Dean J. Kramer
(74) *Attorney, Agent, or Firm*—Quarles & Brady LLP

(57) ABSTRACT

A coin sorting machine (10) has a motor output shaft (31) driving a coin queueing disk (21) and also has a coin sorting assembly (22) having a coin pushing member (24). A power transmission device (32, 34) transmits power from the motor output shaft (31) to a second shaft (36) driving the coin pushing member (24). A coin sensor (**26*b*) senses each coin in a respective denomination as it is sorted into a respective receptacle (17) during a sorting operation. A controller (38) receives signals from the coin sensor (26*b*) determines a last coin in a bag count limit and generates a braking signal to a braking assembly (37) to stop rotation of the second shaft (36) without directly mechanically braking the motor output shaft (31) or the motor (30**).

14 Claims, 3 Drawing Sheets

FIG. 3
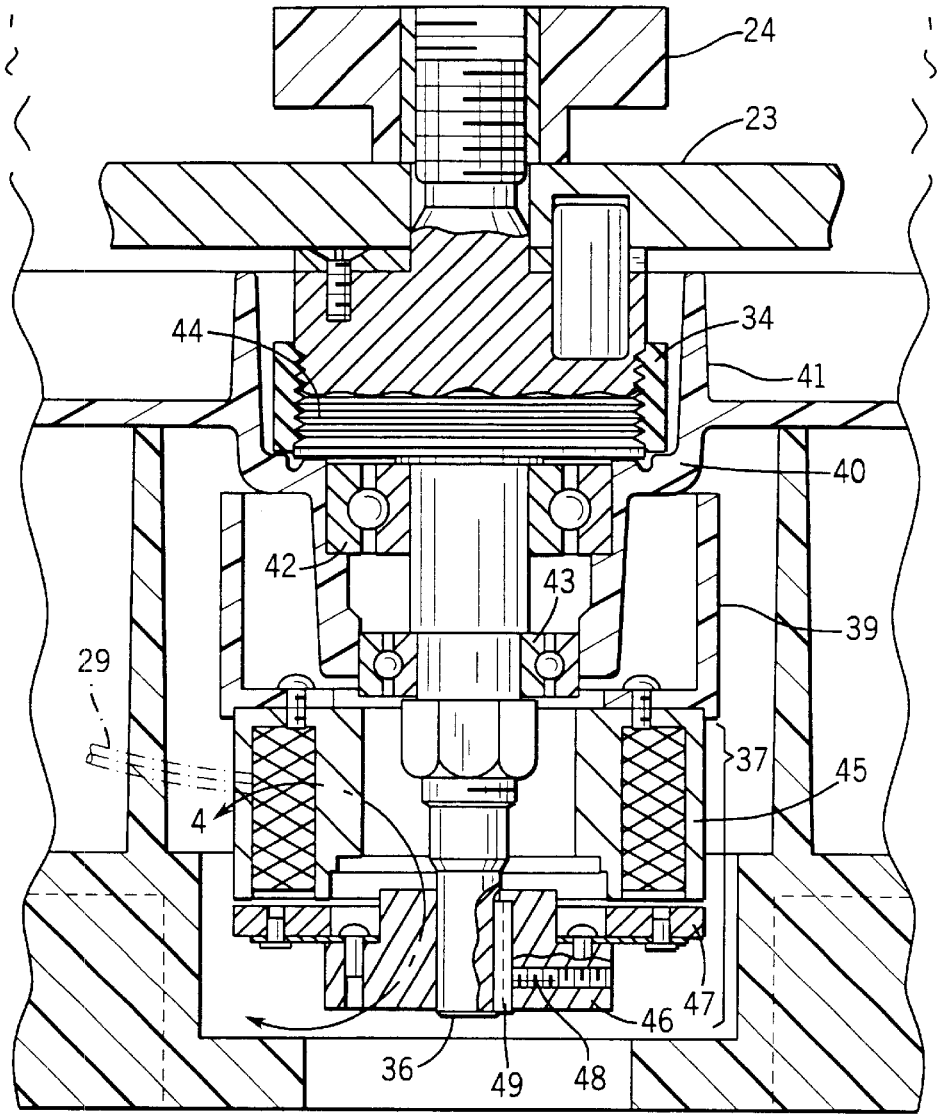
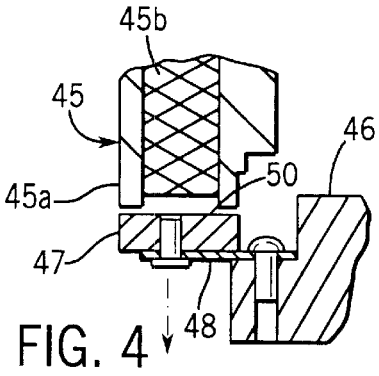
FIG. 4
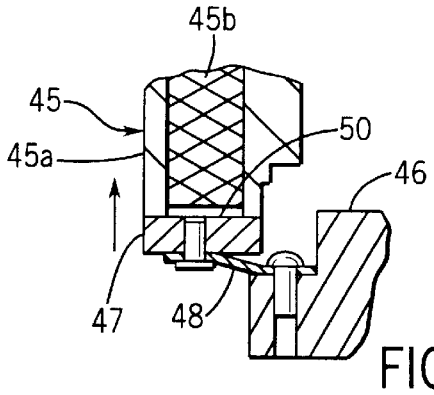
FIG. 5

METHOD AND APPARATUS FOR BAG STOPPING IN A SMALL COIN SORTER

TECHNICAL FIELD

The invention relates to coin processing equipment and, more particularly, to methods and apparatus for bag stopping and braking in coin sorters.

BACKGROUND ART

Coin sorters are used to sort and collect coins by denomination, such as penny, nickel, dime, quarter, half and dollar in the United States. Other denominations may be handled in countries outside the United States. In coin sorters, it has been the practice to attach bags or coin receptacles to collect the coins for respective denominations. As used herein, the term "receptacles" or "bags" shall be understood to include all types of receptacles used to collect coins by denomination including bags, bins, coin tubes and coin wrapper holders and other types of receptacles. The bags are sized and defined to hold a certain number of coins, such as 5000 pennies or 2000 quarters. This number or limit on coins in a receptacle is referred to in the industry as a "bag stop". When this number of coins is reached it is desirable to quickly stop the machine and allow replacement of the filled bag or receptacle with an empty one.

As the coins are being sorted, there is the problem of one of the bags becoming filled to the limit, at which time either the machine has to be stopped, or another bag switched into place to receive more coins of that denomination.

Bag stopping is triggered when a sensor senses the last coin in a bag count. The sensor then signals the machine to stop.

Buchholz, U.S. Pat. No. 2,835,260, issued May 20, 1958, discloses a machine in which a rotating core in a coin sorting assembly is driven by a motor through a belt and a worm drive. An electromechanical brake is mounted on the output shaft end of the motor for braking the motor and thereby stopping rotation of the rotating core in the coin sorting assembly.

In Primdahl, U.S. Pat. No. 4,921,463, issued May 1, 1990, electromechanical braking is accomplished using a brake mechanism coupled to a back end of a motor which drives a rotating member in a coin sorting assembly through a gear assembly.

In Raterman, U.S. Reissue Pat. No. 34,934, reissued May 9, 1995, a controller sends a brake control signal to an electromechanical friction brake on a motor and also sends a brake control signal to a second electromechanical friction brake on a rotating coin disk which is driven by the motor through a speed reducer. The two brakes are applied in a simultaneous manner so as to avoid shock loads on the gear train due to torque differentials on the rotating members as they are brought to a stop.

SUMMARY OF THE INVENTION

The present invention is designed to provide a novel and improved approach for bag stopping in a small coin sorter.

An example of a such a coin sorter is offered under the trade designation "Mach 3" by the assignee of the present invention. Prior to the present invention, the function of exact bag stops was not provided in such a device.

This type of sorter, sometimes referred to as a figure-8 type sorter, has two interrelated rotating disks, a first disk operating as a queueing disk to separate the coins from an initial mass of coins and arrange them in a single file of coins to be fed to a sorting disk assembly. The drive for the queueing disk transmits power through a belt to the coin moving member in the sorting disk assembly.

The invention provides a single brake which operates directly on a shaft on which the coin moving member rotates. There is no electromechanical brake coupled to a motor output shaft as taught in the above-described prior art. It has been discovered that in the present arrangement that braking can be accomplished by braking a shaft on the coin sorting assembly, which is not the motor output shaft, without generating an undue torque differential between the coin sorting assembly shaft and the motor output shaft. The braking is effected by a relatively fast responding controller which responds to coin sensors in the coin sorting assembly to count the last coin in a bag count for a particular denomination and stop the coin sorter by signaling the controller to brake the shaft of the disk in the coin sorter assembly.

In one embodiment, power to the motor is switched off and the motor is stopped quickly by the braking force on the coin moving member. In another embodiment, signals are also sent to the motor to operate the motor in the regenerative mode. This reverses the direction of torque related to the present rotational direction until the motor is brought to a stop.

While the present invention is disclosed in a preferred embodiment based on a specific model of coin sorter, the invention could also be applied as a modification to other types of machines, including the other prior art described above.

Other objects and advantages of the invention, besides those discussed above, will be apparent to those of ordinary skill in the art from the description of the preferred embodiments which follow. In the description, reference is made to the accompanying drawings, which form a part hereof, and which illustrate examples of the invention. Such examples, however, are not exhaustive of the various embodiments of the invention, and therefore, reference is made to the claims which follow the description for determining the scope of the invention.

BRIEF DESCRIPTION OF THE DRAWINGS

FIG. 3 is a transverse sectional view through a drive shaft assembly taken in the plane indicated by line 3—3 seen in FIG. 2;

FIG. 4 is a detail view in the region indicated by line 4—4 in FIG. 3 with the brake coil de-energized; and FIG. 5 is a detail view in the region indicated by FIG. 4 with the brake coil energized.

DETAILED DESCRIPTION OF THE PREFERRED EMBODIMENTS

Figure 1:
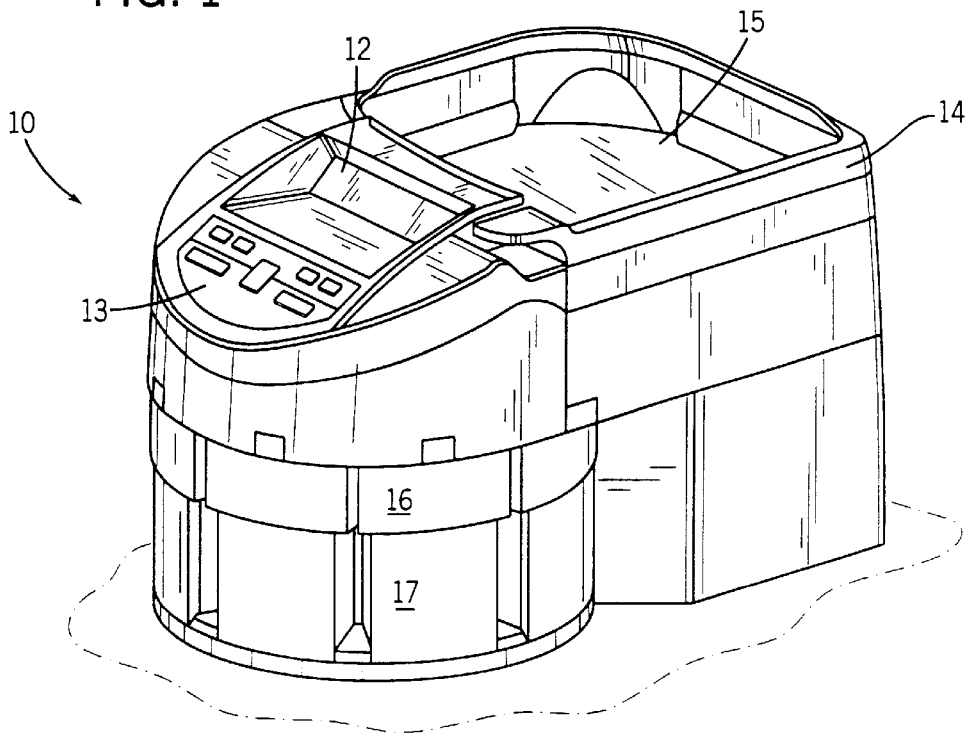
FIG. 1 is a perspective view of a portion of the coin sorter incorporating the present invention.

Referring to FIG. 1, the coin handling machine 10 is a sorter of the type shown and described in Adams et al., U.S. Pat. No. 5,525,104, and offered under the trade designation, "Mach 3" by the assignee of the present invention. Referring to FIG. 1, a first embodiment of the present invention is a coin sorter 10 of a size that could be placed on a desktop, although in other embodiments the sorter could be a floor standing model. The sorter 10 includes a visual display 12 for displaying count totals and a control panel 13 for entering commands and data to control the operation of the machine 10. An upper bezel 14 forms an opening into a hopper 15 for receiving a batch of coins of mixed denominations. These are sorted by a sorting mechanism of the type described in Adams et al., U.S. Pat. No. 5,295,899, issued Mar. 22, 1994, and Adams et al. U.S. Pat. No. 5,525,104, issued Jul. 11, 1996. The coins drop through respective sorting apertures in a sorting plate and are guided into coin chutes 16 and receptacles 17 for respective denominations, such as penny, nickel, dime, quarter, half, and dollar in the United States, and for other denominations in Europe, Canada and other countries.

Figure 2A:
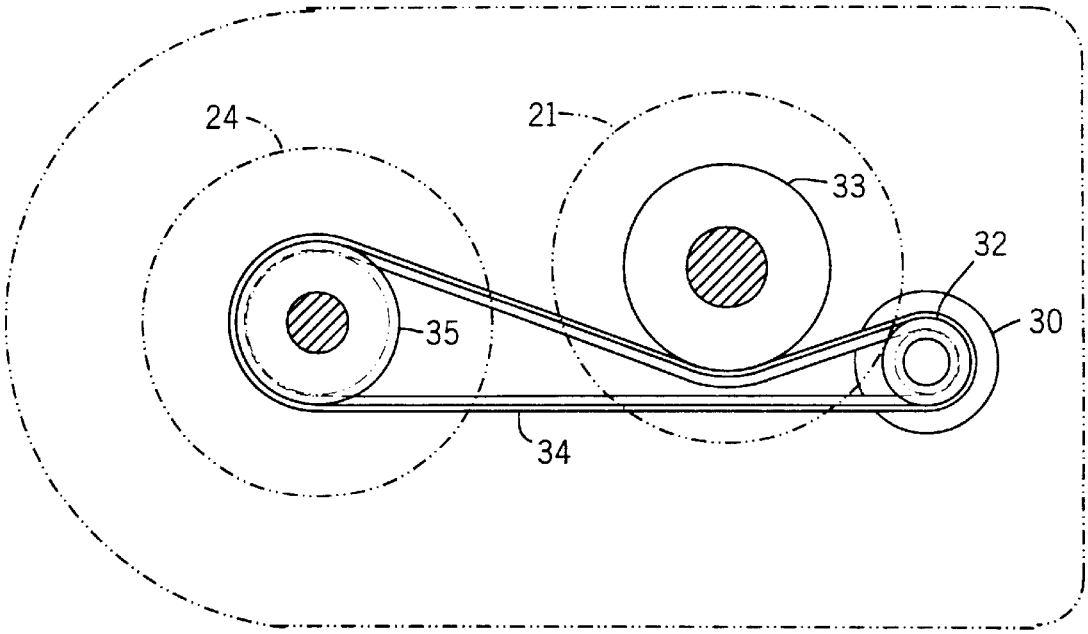
FIG. 2A is a detail sectional view taken in the plane indicated by line 2A—2A in FIG. 2.
Figure 2:
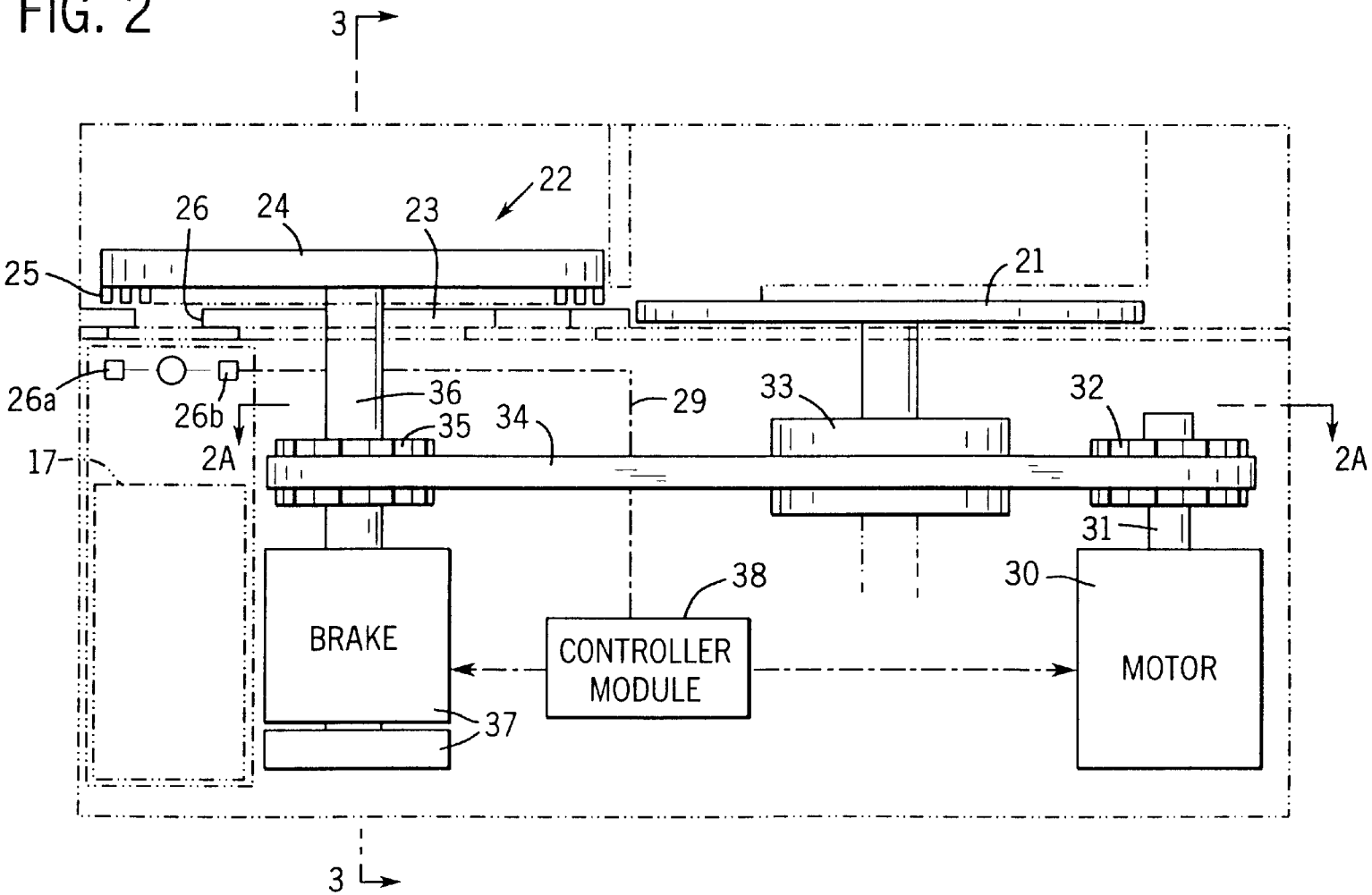
FIG. 2 is a schematic elevational view of the drive mechanisms in the interior of FIG. 1.

This type of sorter 10, is sometimes referred to as a FIG. 8 type sorter. Referring to FIG. 2, it has two interrelated rotating disks, a first disk operating as a queueing disk 21 to separate the coins from an initial mass of coins and arrange them in a single file of coins to be fed to a sorting assembly 22.

As further seen in FIG. 2, the sorting assembly 22 includes an upper, rotatable, coin pushing member 24 with a plurality of flexing webs 25 or fingers which push the coins along a coin sorting path over the sorting apertures 26. The coin pushing member 24 is a disk, which along with the webs 25, is made of a plastic material. The webs 25 are described in more detail in Adams et al., U.S. Pat. No. 5,525,104, issued Jun. 11, 1996. Briefly, they are aligned along radii of the coin pushing member 24, and have a length equal to about the last 30% of the radius from the center of the circular coin pushing member 24.

A reference edge is provided against which the coins are aligned in a single file for movement along the coin sorting path. As the coins are moved clockwise along the coin sorting path by the webs or fingers 25, the coins drop through the sorting apertures 26 (FIG. 2) according to size, with the smallest size coin dropping through the first aperture. As they drop through the sorting apertures 26 the coins are sensed by photo emitters in the form of light emitting diodes (LEDs) 26*a* (FIG. 2) and optical detectors 26*b* (FIG. 2), one emitter and detector per aperture. The coins drop into one of the receptacles 17 seen in FIGS. 1 and 2.

As used herein, the term "apertures" shall refer to the specific sorting openings shown in the drawings. The term sorting opening shall be understood to not only include the apertures, but also sorting grooves, channels and exits seen in the prior art.

FIG. 2 also shows a DC electric motor 30 for driving the queuing disk 21 in the coin sorter 10 through a shaft 31. The motor 30 is connected through a pulley 32 and belt 34 which drives a second pulley 35 and third pulley 33 (seen also in FIG. 2A). The second pulley 35 transfers power to a second shaft 36 directly driving coin pushing member 24 in coin sorting assembly 22. The third pulley 33 transfers torque and power to the queueing disk 21. Referring back to FIG. 2, an electromechanical brake 37 is mounted to the bottom of the second shaft 36. The brake 37 is operated for bag stops and emergency stops.

Still referring to FIG. 2, a controller module 38 receives input signals from the coin detection sensors 26*a*, 26*b*. This controller module 38 has a programmed microelectronic CPU (not shown) which counts the coins for each denomination and compares the number against bag count limits which can be entered or selected through control panel 13 in FIG. 1. When a bag count limit is reached, the controller module 38 transmits a signal to operate the brake assembly 37 and also transmits a signal to turn off power to the motor 30. This will effect a stopping of the coin pushing member 24 in as little as fifteen milliseconds so as prevent another coin from being pushed through the sorting aperture 26.

Referring next to FIGS. 3–5, the brake assembly 37 is supported by a collar 39, which in turn is bolted to a flange 40 of a base plate 41 (the point of attachment being hidden from view in FIG. 3). The base plate 41 forms a circular flange in which two ball bearing assemblies 42, 43 are supported for further supporting shaft 36 and allowing shaft 36 to rotate. Also seen in FIG. 3, is the belt 34 which grips a hub 44 of the shaft 36 which has a plurality of grooves which mesh with groves on an inside of the endless loop belt to provide a good grip on the hub 44 by the belt 34.

The brake assembly 37 more particularly includes a coil assembly 45 and a collar 46 attached to the end of the shaft 36. A bolt 48 extends through a hole in the collar 46 into a key groove 49 in the shaft 36. A ring-shaped brake shoe member 47 of magnetically responsive material is mounted above the collar 46 and is connected via arcuate leaf springs 48 and rivets or other fasteners to the collar 46. The brake shoe member 47 may have a friction-enhanced upper surface 50.

The coil assembly 45 more particularly includes a casing 45*a* and an electromagnetic coil 45*b*. The coil assembly receives a magnetizing signal through an insulated pair of wires 29 (FIG. 3). When a braking signal is received and energizes magnetizing coil 45*b*, it will draw the brake shoe member 47 of magnetically responsive material upwardly as seen in FIG. 5 and cause frictional braking to stop the rotation of shaft 36. The springs 48 act as return springs when the signal is removed, allowing the ring-shaped member 47 to return to its non-braking position seen in FIG. 4.

The main controller module 38 controls the DC drive motor 30. In particular, the main controller 38 is connected to operate a relay or other type of switching device which supplies power to the motor 30. The controller 38 includes a first power supply for operating the DC motor in a forward direction and a second power supply circuit and solid state switching circuits for reversing the voltage applied to the terminals of the motor to provide for operation in the regeneration mode (applying torque in a direction opposite the direction of rotation). In another embodiment, the controller may have a resistor for switching into a circuit between the motor terminals to provide a current path for back emf, which is another way of providing torque in a direction opposite the direction of rotation. Other suitable regeneration mode control circuits are known in the art.

The controller 38 further includes a timing circuit for limiting application of reverse voltage signals or limiting the switching of the resistor into the circuit across the motor terminals for a period from 30 milliseconds to 75 milliseconds. The 75 millisecond limit is imposed to prevent the motor 30 from reversing its direction of rotation from its forward direction.

The controller module 38 processes data from coin detection sensor 26*b* to determine if the coin should be counted. If the answer is affirmative, the coin is added to the count for the respective denomination and compared to the count for a bag count limit number. If a bag count limit is determined, the controller module 38 first transmits a signal to turn off power to the motor 30, and optionally, to provide operation in the regenerative mode to slow the motor 30. The controller module 38 also transmits a signal to the electromechanical brake assembly 37 to apply the brake to the shaft 36. There is some delay in response to this signal such that the operation in the regenerative mode occurs prior to application of the electromechanical brake assembly 37 to the shaft 36. This results in stopping rotation of the coin pushing member 24.

At that time the coin pushing member 24 and the motor 30 are stopped, the operator is signaled through a visual or audible alarm or both to replace the filled receptacle 17 with an empty receptacle and restart the machine 10.

This has been a description of a method and apparatus for stopping in a coin sorting machine by braking a coin sorting assembly separately from a motor. Those of ordinary skill in this art will recognize that still other modifications might be made while still coming within the spirit and scope of the invention and, therefore, to define the embodiments of the invention, the following claims are made.

We claim:

1. In a coin sorter having a queueing assembly and a coin sorting assembly, a method of limiting further movement of coins as a bag count limit is reached for a respective denomination, the method comprising:

coupling a first shaft comprising a motor output shaft to a power transmission assembly that drives both a queuing assembly and a sorting assembly;

wherein said sorting assembly has a second shaft;

signaling a braking mechanism coupled to the second shaft;

mechanically braking the second shaft without directly mechanically braking the motor output shaft; and removing forward electrical power supplied to the motor.

2. The method of claim 1, further comprising:

sensing each coin and signaling a controller as each coin is sorted into a respective receptacle;

determining when a bag count limit has been reached; and signaling the braking mechanism to apply the brake to stop rotation of the second shaft.

3. The method of claim 1, further comprising controlling the motor to operate the motor in regenerative mode to assist in bringing the motor to a stop.

4. The method of claim 3, including timing the interval of the electrical signals to operate the motor in the regenerative mode, to prevent reversing a direction of rotation for the motor.

5. The method of claim 1, further comprising driving both the queuing assembly and the sorting assembly through a common belt.

6. A coin handling machine having a coin sorting assembly, having a coin queuing disk, and having a motor output shaft as an axial drive shaft of the coin queueing disk, the coin handling machine further comprising:

the coin sorting assembly having a coin pushing member that is driven by an input shaft;

a power transmission device transmitting power from said motor output shaft to said input shaft;

at least one coin sensor for sensing each coin in a respective denomination as it is sorted into a receptacle during a sorting operation;

a controller for receiving signals from the coin sensor and responsive thereto to determine a last coin in a bag count limit and to generate at least one control signal;

a braking mechanism mounted to the input shaft and responsive to the control signal from the controller for mechanically braking the input shaft without directly mechanically braking the motor output shaft; and wherein said controller removes forward electrical power supplied to the motor.

7. The coin handling machine of claim 6, wherein said controller transmits signals to operate the motor in a regeneration mode and bring the motor to a stop.

8. The coin handling machine of claim 7, wherein the controller limits the time of the signals that operate the motor in a regenerative mode to prevent reversing a direction of rotation for the motor.

9. The coin handling machine of claim 6, wherein the coin sorting assembly includes a coin pushing member with depending flexible webs that is rotated to push the coins along a coin sorting path; and wherein the coin sorting assembly includes a sorting member with a plurality of sorting openings.

10. The coin handling machine of claim 9, wherein the sorting member is a plate and the sorting openings are apertures in the plate.

11. The coin handling machine of claim 6, wherein the power transmission device includes a first pulley driven by the motor output shaft, a second pulley coupled to the input shaft and a belt transmitting power from the first pulley to the second pulley.

12. The coin handling machine of claim 11, wherein the power transmission device includes a third pulley coupled to the queuing disk.

13. The coin handling machine of claim 6, wherein there are a plurality of coin sensors corresponding to respective denominations.

14. The coin handling machine of claim 6, wherein each coin sensor has a light emitter and a light detector for detecting the presence of a coin interrupting the path of light from the light emitter to the light detector.

* * * * *